US009273416B2

(12) United States Patent
Ban

(10) Patent No.: US 9,273,416 B2
(45) Date of Patent: Mar. 1, 2016

(54) COMPOSITE YARN, FABRIC, AND AUTOMOTIVE INTERIOR MATERIAL MADE FROM PAPER

(71) Applicant: Hyundai Motor Corporation, Seoul (KR)

(72) Inventor: Si Young Ban, Gyeonggi-Do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/474,897

(22) Filed: Sep. 2, 2014

(65) Prior Publication Data

US 2014/0370772 A1 Dec. 18, 2014

Related U.S. Application Data

(62) Division of application No. 13/237,153, filed on Sep. 20, 2011, now Pat. No. 8,844,255.

(30) Foreign Application Priority Data

Mar. 17, 2011 (KR) ..... 10-2011-0024006

(51) Int. Cl.
*D03D 15/00* (2006.01)
*D02G 3/08* (2006.01)
(Continued)

(52) U.S. Cl.
CPC ..... *D03D 15/0027* (2013.01); *D02G 1/0293* (2013.01); *D02G 3/04* (2013.01); *D02G 3/08* (2013.01); *D02G 3/36* (2013.01); *D02G 3/38* (2013.01); *D02G 3/443* (2013.01); *D02G 3/446* (2013.01); *D03D 15/0072* (2013.01); *D03D 15/0094* (2013.01); *D10B 2321/022* (2013.01); *D10B 2331/04* (2013.01);
(Continued)

(58) Field of Classification Search
CPC . D03D 15/0027; D03D 15/0072; D02G 3/36; D02G 3/446; D02G 3/04; D02G 3/08
See application file for complete search history.

(56) References Cited

U.S. PATENT DOCUMENTS 1,613,179 A 1/1927 Long
1,944,786 A 1/1934 Dodge
(Continued)

FOREIGN PATENT DOCUMENTS

CN 1986925 A 6/2007
CN 200974887 Y 11/2007
(Continued)

*Primary Examiner* — Shaun R Hurley
(74) *Attorney, Agent, or Firm* — Mintz Levin Cohn Ferris Glovsky and Popeo, P.C.; Peter F. Corless

(57) ABSTRACT

The present invention provides a method for manufacturing a composite yarn of paper, e.g., traditional Korean paper, and a composite yarn manufactured thereby, a method for manufacturing a fabric using the same and an automotive interior material manufactured thereby. More particularly, the present invention relates to a method for manufacturing a composite yarn of traditional Korean paper by using a traditional Korean paper yarn and a synthetic yarn, in which the composite yarn can be used in weaving and knitting, and a method for manufacturing a fabric as an automotive interior material using the same. Accordingly, the present invention provides a method for manufacturing a composite yarn of paper, comprising twisting a tape-type paper yarn, and covering the twisted paper yarn as a ground yarn at least two strands of synthetic yarn as an effect yarn to manufacture a composite yarn of paper of 160~700 denier.

4 Claims, 2 Drawing Sheets

(51) Int. Cl.

| | |
|---|---|
| ***D02G 3/38*** | (2006.01) |
| ***D02G 1/02*** | (2006.01) |
| ***D02G 3/04*** | (2006.01) |
| ***D02G 3/36*** | (2006.01) |
| ***D02G 3/44*** | (2006.01) |

(52) U.S. Cl.
CPC ..... *Y10T 442/2631* (2015.04); *Y10T 442/2656* (2015.04); *Y10T 442/2705* (2015.04); *Y10T 442/2713* (2015.04); *Y10T 442/30* (2015.04); *Y10T 442/3073* (2015.04)

(56) References Cited

U.S. PATENT DOCUMENTS

| | | | | |
|---|---|---|---|---|
| 2,107,467 | A | 2/1938 | Buhler | |
| 2,486,037 | A | 10/1949 | Lambert | |
| 2,816,415 | A | 12/1957 | Lappala | |
| 2,832,190 | A | 4/1958 | Bacon | |
| 2,979,982 | A | 4/1961 | Weitzel | |
| 3,349,552 | A * | 10/1967 | Port et al. | 57/31 |
| 3,482,483 | A | 12/1969 | Ambrose | |
| 3,735,579 | A | 5/1973 | Catlos | |
| 4,430,384 | A | 2/1984 | George | |
| 4,581,882 | A | 4/1986 | Pallo et al. | |
| 4,598,622 | A | 7/1986 | Briggs | |
| 6,022,618 | A * | 2/2000 | Arai | 428/357 |
| 7,886,513 | B2 | 2/2011 | Kim et al. | |
| 2009/0151139 | A1 | 6/2009 | Kim et al. | |
| 2011/0095931 | A1 * | 4/2011 | Child | 342/3 |

FOREIGN PATENT DOCUMENTS

| | | | |
|---|---|---|---|
| GB | 2060010 | A | 4/1981 |
| JP | 2004-036041 | A | 2/2004 |
| JP | 2004124311 | A | 4/2004 |
| JP | 2005089892 | A | 4/2005 |
| JP | 2005089893 | A | 4/2005 |
| JP | 2005-299020 | A | 10/2005 |
| KR | 10-2005-0017717 | | 2/2005 |
| KR | 10-2009-0064900 | A | 6/2009 |
| KR | 10-2009-0125867 | | 12/2009 |
| KR | 10-2010-0111371 | | 10/2010 |
| KR | 10-2010-0125013 | | 11/2010 |

* cited by examiner

COMPOSITE YARN, FABRIC, AND AUTOMOTIVE INTERIOR MATERIAL MADE FROM PAPER

CROSS-REFERENCE TO RELATED APPLICATION

This application is a Divisional Application of U.S. Ser. No. 13/237,153, filed Sep. 20, 2011, which claims under 35 U.S.C. §119(a) the benefit of Korean Patent Application No. 10-2011-0024006 filed Mar. 17, 2011, the entire contents of which are incorporated herein by reference.

BACKGROUND (a) Technical Field

The present invention relates to a composite yarn of paper, e.g., traditional Korean paper, and also a fabric made using the same and an automotive interior material manufactured thereby.

(b) Background Art

A traditional Korean paper, called 'hanji', a natural fiber made from the bark of pine tree, dak (mulberry) tree, or the like, has excellent properties such as texture, dyeing property, air permeability, moisture absorbing ability, or wear sensation, and is thus generally used in clothing or other interior fabrics. It is also expected to be used in a wide variety of applications.

To weave or knit the traditional Korean paper yarn into a woven or knitted fabric, the yarn should have a uniform thickness due to its smoothness and have minimal tension, durability, and elasticity required for a weaving/knitting process. Therefore, a processing of twisting the yarn is needed.

Conventionally, the traditional Korean paper yarn is manufactured by slitting a sheet of Korean paper at a predetermined width and then twisting the slit paper. However, the twisting process of the slit paper is problematic in that the manufactured yarn has an uneven thickness due to its rough surface and yarn breakage frequently occurs due to low tensile strength and elongation upon weaving/knitting, and thus the manufactured fabric has an uneven texture.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention has been made in an effort to alleviate the above-described problems associated with prior art.

In one aspect, the present invention provides a method for manufacturing a composite yarn of traditional Korean paper, in which a traditional Korean paper yarn having weak durability such as strength is covered with a synthetic yarn to manufacture the composite yarn of traditional Korean paper having smoothness and elongation suitable for weaving/knitting.

In an illustrative embodiment, the present invention provides a method for manufacturing a composite yarn of traditional Korean paper, comprising twisting a tape-type Korean paper yarn, and covering the twisted Korean paper yarn as a ground yarn with at least two strands of synthetic yarn as an effect yarn to manufacture a composite yarn of traditional Korean paper of 160~700 denier.

In another illustrative embodiment, the synthetic yarn is one selected from polyester yarns, polypropylene fibers, and synthetic fibers manufactured with dyed yarn or dope dyed yarn.

In another aspect, the present invention provides a method for manufacturing a fabric using the composite yarn of traditional Korean paper of the present invention manufactured by using a traditional Korean paper yarn and a synthetic yarn. In particular, the present invention provides a woven/knitted interior material for use in vehicles (seat cover, ceiling materials, and door trim), satisfying the physical properties (light resistance, abrasion resistance, flame resistance, etc.).

In an illustrative embodiment, the present invention provides a method for manufacturing a fabric, characterized in that the composite yarn of traditional Korean paper manufactured by the above described method is used as a yarn to manufacture a fabric having a warp yarn density of 80~120 yarns/inch and a weft yarn density of 40~50 yarns/inch.

In another illustrative embodiment, the fabric is treated with hydrogen peroxide ($H_2O_2$), a soaping agent, and sodium hydroxide (NaOH) in a dyeing machine at 98° C. for approximately 20 min.

In still another illustrative embodiment, in the fabric, the warp yarn is thinner than the weft yarn.

In still another illustrative embodiment, the back of the fabric is coated with an acrylic resin coating liquid containing any one or two selected from a decabrom-based flame retardant, an antimony-based flame retardant, a phosphorus-based flame retardant, and a stabilizer.

In still another illustrative embodiment, the fabric is heat-treated at 160° C. or lower in order to dry the acrylic resin coating liquid coated on the back.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
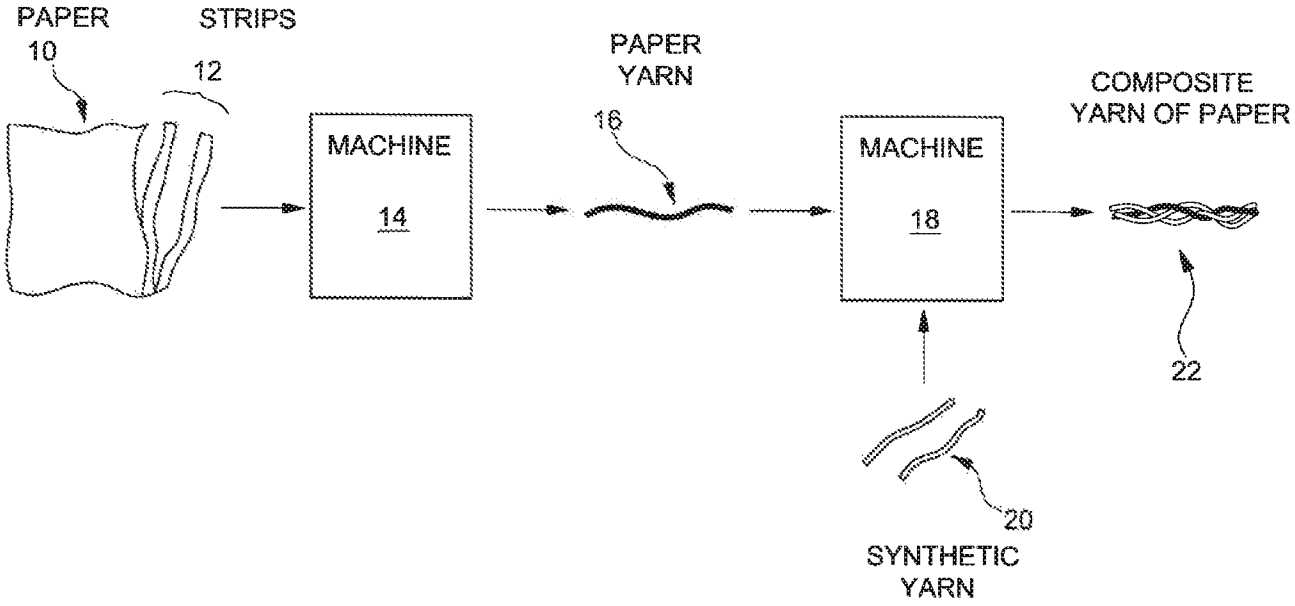
FIG. 1 is an illustrative view of manufacturing a composite yarn of traditional Korean paper according to the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Also, it is understood that the term "vehicle" or "vehicular" or other similar automotive term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

The present invention relates to a method for manufacturing a composite yarn of paper, e.g., traditional Korean paper, suitable for weaving/knitting using a high value-added Korean paper yarn having antibacterial and deodorizing performances, moisture absorption and quick-drying properties, and light weight, human body-friendly, and far-infrared emission characteristics, and the composite yarn of traditional Korean paper of the present invention is used to manufacture a woven/knitted interior material for use in vehicles (seat cover, ceiling materials, door trim or the like).

Because of characteristics of Korean paper, the traditional Korean paper yarn is generally in a form of slit tape having a predetermined width (within 1~3 mm) unlike ordinary fibers, and thus yarn breakage frequently occurs like paper. Therefore, it is difficult to weave and knit the traditional Korean paper yarn using a general knitting machine.

In the present invention, a specialized doubling and twisting machine is used to provide the traditional Korean paper yarn with smoothness and elongation suitable for weaving/knitting, and the tape-type Korean paper yarn is first twisted, and then the twisted Korean paper yarn as a ground yarn is covered with at least two strands of dyed synthetic yarn as an effect yarn to manufacture a composite yarn of traditional Korean paper suitable for weaving/knitting.

Hereinafter, the present invention will be described in detail with reference to the accompanying drawings.

A. Manufacture of Yarn

With reference to FIG. 1, to obtain a composite yarn of traditional Korean paper 10 having uniform surface smoothness and excellent tensile strength, durability, and elasticity, which is suitable for weaving/knitting a fabric as an automotive interior material, the traditional Korean paper yarn is first manufactured by twisting the traditional Korean paper slit 12 having a predetermined width (e.g., by machine 14), and then the traditional Korean paper yarn 16 as a ground (base) yarn is placed in a machine 18 (specialized doubling and twisting machine) together with a polyester yarn 20, followed by covering the traditional Korean paper yarn with the polyester yarn.

Upon performing the covering process, the substantially loose Korean paper yarn is covered with the polyester yarn under high tension to give elasticity to a final covered yarn (or composite yarn of traditional Korean paper 22), and a load is mainly applied to the polyester yarn rather than the traditional Korean paper yarn, thereby manufacturing a final yarn (or composite yarn of traditional Korean paper) having a strength similar to that of polyester yarn.

That is, the traditional Korean paper yarn first manufactured is used as a ground yarn, and at least two strands of dyed polyester yarn are used as an effect yarn to cover the traditional Korean paper yarn, thereby manufacturing a final yarn (or composite yarn of traditional Korean paper).

During the covering process, since the composite yarn of traditional Korean paper is twisted to give a regular twist, the strength of the final yarn (composite yarn of traditional Korean paper) is improved, and the surface smoothness is also improved.

The composite yarn of traditional Korean paper manufactured has smoothness, durability, and elasticity suitable for weaving/knitting, and the surface of Korean paper yarn is also mostly covered with the polyester yarns to solve the drawback of Korean paper yarn, abrasion resistance.

Further, since the traditional Korean paper yarn is not completely (100%) covered with the polyester yarn, the manufactured fabric has a finely white speckled appearance due to the traditional Korean paper yarn that is partially covered with the dyed polyester yarn. Therefore, a two-tone automotive interior material can be manufactured in a variety of colors by adjusting the exposure degree of Korean paper yarn according to the covering method.

As described above, the traditional Korean paper yarn is covered with polyester as an effect yarn, but polypropylene fibers or other synthetic fibers manufactured with dyed yarn or dope dyed yarn can be used.

That is, the effect yarn covering the traditional Korean paper yarn includes polyester yarns as well as all kinds of synthetic fibers manufactured with dyed yarn or dope dyed yarn, for example, nylon, polypropylene, acrylic or the like.

Further, while the paper 10 is shown as traditional Korean paper, other papers with similar qualities and features may be used.

B. Manufacture of Fabric

1) Woven Seat Cover Fabric

Figure 2:
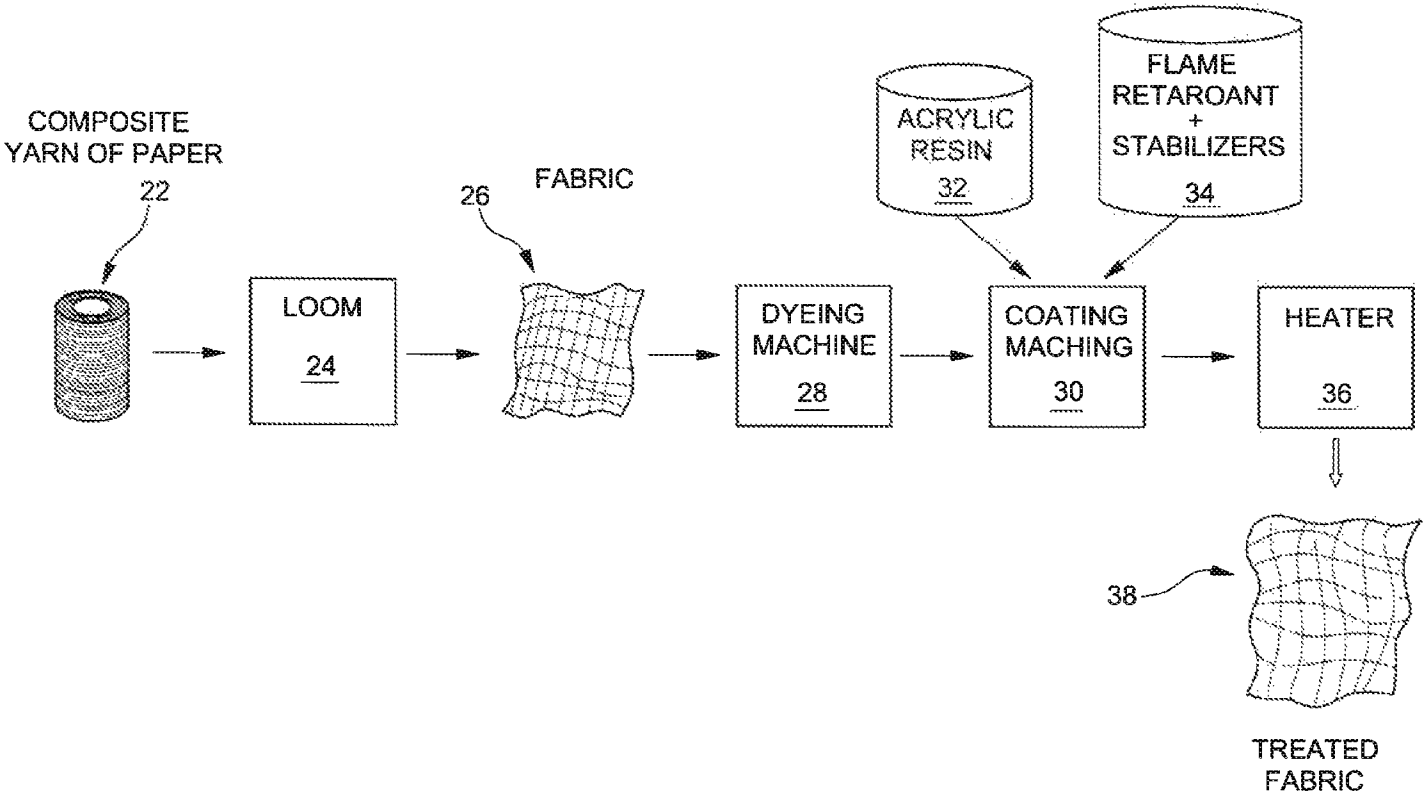
FIG. 2 is an illustrative view of manufacturing a fabric manufactured using the composite yarn of traditional Korean paper according to the present invention.

The composite yarn of traditional Korean paper manufactured in section A has strength, elongation, and smoothness suitable for weaving/knitting, regardless of the type of loom 24 such as dobby or jacquard loom, as in FIG. 2.

The traditional Korean paper yarn can be generally slit in a tape-type having various widths of 1~3 mm, and a Korean paper tape with a width of 1 mm has a thickness of approximately 115 denier.

The final Korean "paper&PET" covered yarn, which is manufactured using the traditional Korean paper as a ground yarn and a PET yarn (e.g., polyester, or more particularly, polyethylene terephthalate) as an effect yarn according to the present invention, can be manufactured to have a variety of thickness of approximately 160 denier~700 denier by combinations of the traditional Korean paper slit with a variety of width and PET yarn with a variety of thickness. Also, different colored PET yarns are used to manufacture different colored products.

As the final Korean paper&PET covered yarn (or composite yarn of traditional Korean paper) is thinner, its strength is reduced, and thus yarn breakage frequently occurs upon weaving/knitting. As it is thicker, the weft yarn or warp yarn density per inch becomes low, thereby deteriorating the physical properties such as tensile strength, tearing strength, sewing strength, and sewing fatigue.

To prevent deterioration of the physical properties, it is preferable that a yarn of 200~500 denier is used, and a final product (namely, fabric manufactured using the composite yarn of traditional Korean paper) has a warp yarn density of 80~120 yarns/inch and a weft yarn density of 40~50 yarns/inch depending on the type of weaving machine.

If a final density of fabric is too high, the elongation rate is reduced, and thus difficulties are generated upon covering a seat frame with the seat cover. Therefore, it is important that the fabric be manufactured to have a proper elongation rate without deterioration of the physical properties.

Upon weaving the fabric, a weft yarn and a warp yarn having the same thickness may be used, but a thinner warp yarn is more preferably used, because a high-density fabric is favorable in order to improve durability of sewing strength and sewing fatigue.

In addition, upon weaving the fabric, a weft yarn/warp yarn may be the same. However, the traditional Korean paper & dyed PET covered yarn is very expensive than other synthetic fibers. Therefore, in terms of cost reduction, it is preferable that instead of using 100% of Korean paper&PET covered yarn as a weft/warp yarn, dyed PET yarn or general PET yarn (or Korean paper&PET covered yarn) is used as a warp yarn, and Korean paper&PET covered yarn (or dyed PET yarn or general PET yarn) is used as a weft yarn to manufacture a fabric, in which 80~90% of the traditional Korean paper&PET covered yarn is protruded from the surface of fabric. That is, products at all prices can be manufactured by designing the weaving structure of fabrics in various ways.

Meanwhile, a fabric woven using the traditional Korean paper & dyed PET covered yarn may have a rather rough texture due to the stiff Korean paper yarn.

Therefore, since an automotive interior material requires soft texture, the woven fabric 26 of the present invention may be treated with hydrogen peroxide ($H_2O_2$), a soaping agent, and sodium hydroxide (NaOH) in a dyeing machine 28 at approximately 98° C. for about 20 min to improve the texture.

During the process of improving texture, a thermal shrinkage effect can be also obtained. The density and bulkiness of fabric are increased by the thermal shrinkage effect and consequently, its appearance and texture are improved.

Unlike a knitted fabric manufactured by knotting warp and weft yarns, the woven fabric manufactured by intersecting warp and weft yarns has a loose texture, and thus physical properties such as sewing fatigue may be deteriorated upon sewing the fabric for a seat cover. In order to prevent this problem, it is preferable that the back of the woven fabric is coated (coating machine 30) with an acrylic resin 32 to increase the interactive binding effect between warp and weft yarns.

At this time, in order to ensure flame retardance of the woven fabric, the acrylic resin coating liquid is added with a decabrom-based flame retardant, an antimony-based flame retardant and other stabilizer at a predetermined amount (34).

After coating the woven fabric, heat treatment is performed to dry the coating liquid in heater 36. At this time, if the heat treatment temperature is too high, the traditional Korean paper yarn may turn yellow. Thus, it is preferable that heat treatment is performed at 160° C. or below.

More preferably, in order to prevent yellowing, an environment-friendly phosphorus-based flame retardant without a sulfur compound that makes the fabric yellow is used as the flame retardant that is added to the acrylic resin coating liquid for flame retardance of the woven fabric, and heat treatment is performed at 140° C. or below to dry the coating liquid.

The traditional Korean paper&PET composite woven fabric 38 (treated) for automotive seat cover manufactured by the above processes has a soft texture, and the lack of abrasion resistance of Korean paper yarn is also improved by covering with PET yarn. Thus, the woven fabric has abrasion resistance required for automotive interior materials. In addition, shape stability and flame retardance can be also satisfied by flame retardant back coating.

EXAMPLES

The following examples illustrate the invention and are not intended to limit the same.

Hereinafter, the present invention will be described in more detail with reference to the following Examples.

Example 1

Manufacture of Korean Paper & Dyed PET Covered Yarn for Automotive Seat Cover A Korean paper & dyed PET covered yarn (composite yarn of traditional Korean paper) was manufactured according to the method for manufacturing a composite yarn of traditional Korean paper according to the present invention. At this time, the twisting and doubling conditions are the same as in Table 1.

TABLE 1

| Composite yarn of traditional Korean paper (denier) | Ground yarn | Effect yarn | Twisting and doubling mode | Blend ratio (%) | Note |
|---|---|---|---|---|---|
| 480d | Traditional Korean paper yarn of 1.5 mm width (180d) | Dyed PET yarn 150d/48f 2 strands | MH (Single covering) TM 800 | Traditional Korean paper:PET = 38:62 | Woven fabric |
| 330d | Traditional Korean paper yarn of 1.5 mm width (180d) | Dyed PET yarn 75d/36f 2 strands | MH (Single covering) TM 800 | Traditional Korean paper:PET = 54:46 | Knitted fabric (Double knit) |

Example 2

Manufacture of Traditional Korean Paper & Dyed PET Covered Yarn for Automotive Ceiling Material A traditional Korean paper & dyed PET covered yarn (composite yarn of traditional Korean paper) was manufactured according to the method for manufacturing a composite yarn of traditional Korean paper according to the present invention. At this time, the twisting and doubling conditions are the same as in Table 2.

TABLE 2

| Composite yarn of traditional Korean paper (denier) | Ground yarn | Effect yarn | Twisting and doubling mode | Blend ratio (%) | Note |
|---|---|---|---|---|---|
| 330d | Traditional Korean paper yarn of 1.5 mm width (180d) | Dyed PET yarn 75d/36f 2 strands | MH (Single covering) TM 800 | Traditional Korean paper:PET = 54:46 | Knitted fabric |
| 255d | Traditional Korean paper yarn of 1.5 mm width (180d) | Dyed PET yarn 75d/36f 2 strands | MH (Single covering) TM 800 | Traditional Korean paper:PET = 70:30 | Knitted fabric |

The result of manufacturing a composite yarn of traditional Korean paper according to Example 1 showed that the traditional Korean paper & dyed PET covered yarn of FIG. 1 was manufactured. The result of Example 2 also showed that the traditional Korean paper & dyed PET covered yarn similar to FIG. 1 was manufactured.

In addition, the traditional Korean paper & dyed PET covered yarn of FIG. 1 can be used to manufacture a fabric of FIG. 2.

Example 3

Manufacture of Automotive Seat Cover Using Traditional Korean Paper & Dyed PET Covered Yarn A fabric for automotive seat cover was woven using a traditional Korean paper & dyed PET covered yarn that was manufactured according to the method for manufacturing a composite yarn of traditional Korean paper according to the present invention. At this time, conditions of manufacturing the composite yarn of traditional Korean paper and fabric are the same as in Table 3.

TABLE 3

| Order | | Yarn | Application |
|---|---|---|---|
| 1 | Warp yarn | 480 de. (Traditional Korean paper yarn of 1.5 mm width/Dyed PET yarn 150d/48f 2 strands) | Seat cover Main, Side |
| 1 | Weft yarn | 480 de. (Traditional Korean paper yarn of 1.5 mm width/Dyed PET yarn 150d/48f 2 strands) | Seat cover Main, Side |
| 2 | Warp yarn | 330 de. (Traditional Korean paper yarn of 1.5 mm width/Dyed PET yarn 75d/36f 2 strands) | Seat cover Main, Side |
| 2 | Weft yarn | 480 de. (Traditional Korean paper yarn of 1.5 mm width/Dyed PET yarn 150d/48f 2 strands) | Seat cover Main, Side |
| 3 | Warp yarn | 330 de. (Traditional Korean paper yarn of 1.5 mm width/Dyed PET yarn 75d/36f 2 strands) | Seat cover Main, Side |
| 3 | Weft yarn | 330 de. (Traditional Korean paper yarn of 1.5 mm width/Dyed PET yarn 75d/36f 2 strands) | Seat cover Main, Side |
| 4 | Warp yarn | 330 de. Dyed PET yarn | Seat cover Main, Side |
| 4 | Weft yarn | 480 de. (Traditional Korean paper yarn of 1.5 mm width/Dyed PET yarn 150d/48f 2 strands) | Seat cover Main, Side |
| 5 | Warp yarn | 300 de. Dyed PET yarn | Seat cover Main, Side |
| 5 | Weft yarn | 330 de. (Traditional Korean paper yarn of 1.5 mm width/Dyed PET yarn 75d/36f 2 strands) | Seat cover Main, Side |

The result of manufacturing an automotive seat cover according to Example 3 showed that an automotive seat cover was woven. Therefore, it can be seen that the composite yarn of traditional Korean paper of the present invention can be used to manufacture a woven fabric.

Example 4

Manufacture of Automotive Ceiling Material Using Korean Paper & Dyed PET Covered Yarn A fabric for automotive ceiling material was manufactured using a Korean paper & dyed PET covered yarn that was manufactured according to the method for manufacturing a composite yarn of traditional Korean paper according to the present invention. At this time, conditions of manufacturing the composite yarn of traditional Korean paper and fabric are the same as in Table 4.

TABLE 4

| Order | Blend ratio | Yarn | Application |
|---|---|---|---|
| 1 | 94% | 330 de. (Traditional Korean paper yarn of 2.0 mm width/PET yarn 50d/24f 2 strands) | Ceiling material (Circular Knit, □□□) |
| | 6% | Dyed PET DTY 75d/36f | |
| 2 | 88% | 255 de. (Traditional Korean paper yarn of 2.0 mm width/PET yarn 50d/24f 2 strands) | |
| | 12% | Dyed PET DTY 75d/36f | |
| 3 | 100% | 330 de. (Traditional Korean paper yarn of 2.0 mm width/ dyed PET yarn 50d/24f 2 strands) | |
| 4 | 100% | 330 de. (Traditional Korean paper yarn of 1.5 mm width/ dyed PET yarn 75d/36f 2 strands) | |
| 5 | 100% | 255 de. (Traditional Korean paper yarn of 1.5 mm width/ dyed PET yarn 75d/36f 1 strand) | |

The result of manufacturing an automotive ceiling material according to Example 4 showed that an automotive ceiling material was knitted. A ceiling material can thus be knitted by blending dyed PET yarn and Korean paper & dyed PET covered yarn (order 1, 2) or by using Korean paper & dyed PET covered yarn only (order 3~5). Therefore, it can be seen that the composite yarn of traditional Korean paper of the present invention can be used to manufacture a fabric.

Example 5

Test on Antibacterial Activity of Automotive Interior Material Manufactured Using Korean Paper & Dyed PET Covered Yarn A fabric for automotive interior material was manufactured using a Korean paper & dyed PET covered yarn according to the method for manufacturing a composite yarn of traditional Korean paper of the present invention, and its antibacterial activity was evaluated. At this time, contents of Korean paper yarn are shown in Table 5.

TABLE 5

| | Korean paper yarn content 0% | Korean paper yarn content 40% |
|---|---|---|
| Initial number of bacteria | $2.0 \times 10^4$ | $2.0 \times 10^4$ |
| Number of bacteria after 18 hrs | $4.0 \times 10^7$ | $1.3 \times 10^4$ |
| Rate of bactericidal activity | — | 99.9 |

Test method: KS K 0693, Test strain: *Klebesiela pneumojae* ATCC 4352

The result of evaluating antibacterial activity of automotive interior material manufactured using Korean paper & dyed PET covered yarn according to Example 5 showed the bactericidal activity of Table 5.

Therefore, it can be seen that the content of Korean paper yarn is controlled during manufacture of the composite yarn of traditional Korean paper of the present invention, thereby providing an antibacterial activity for the fabric that is manufactured using the composite yarn of traditional Korean paper, for example, automotive interior materials.

The automotive interior material manufactured by the above process is a product having an antibacterial activity, and the antibacterial performance can be increased to 80% or higher. The content of Korean paper yarn in the composite yarn of traditional Korean paper is also controlled to provide antibacterial and deodorizing performances.

According to the present invention, a composite yarn of traditional Korean paper having smoothness and elongation suitable for weaving/knitting can be manufactured by covering the twisted tape-tape Korean paper yarn as a ground yarn with two or more strands of synthetic yarn as an effect yarn, and the composite yarn of traditional Korean paper of the present invention is used to manufacture woven and knitted fabrics applied to automotive interior materials.

EFFECT OF THE INVENTION

According to the present invention, a composite yarn of traditional Korean paper having smoothness and elongation suitable for weaving/knitting can be manufactured using a traditional Korean paper yarn having antibacterial and deodorizing performances, moisture absorption and quick-drying properties, and light weight, human body-friendly, and far-infrared emission characteristics, and thus high value-added fabric products having the functions of Korean paper yarn, in particular, automotive interior materials can be manufactured using the same.

What is claimed is:

1. A fabric, comprising:

a warp yarn having density of 80~120 yarns/inch; and a weft yarn having density of 40~50 yarns/inch;

wherein the warp yarn and weft yarn comprise a composite yarn of paper consisting of a twisted tape-type paper yarn as a ground yarn and at least two strands of synthetic yarn as an effect yarn covering the twisted paper yarn, wherein the composite yarn of paper has 160~700 denier, wherein the fabric is woven from the warp yarn and the weft yarn comprising the composite yarn of paper and the woven fabric is treated with hydrogen peroxide ($H_2O_2$), a soaping agent, and sodium hydroxide (NaOH) in a dyeing machine at approximately 98° C. for approximately 20 min, wherein the woven fabric further comprises an acrylic resin coating on a back of the fabric, the acrylic resin coating containing any one or two selected from a decabrom-based flame retardant, a phosphorus-based flame retardant, and a stabilizer.

2. The fabric according to claim 1, wherein the warp yarn of the fabric is thinner than the weft yarn.

3. The fabric according to claim 1, wherein the paper is traditional Korean paper.

4. The fabric according to claim 1, wherein the fabric is an automotive interior material.

* * * * *